US006112446A

United States Patent [19]

Förster et al.

[11] Patent Number: 6,112,446

[45] Date of Patent: Sep. 5, 2000

[54] REPLACEABLE WEAPON GRIP

[75] Inventors: Theobald Förster, Jestetten, Germany; Joachim Schmidt, Winterthur, Switzerland

[73] Assignee: SIG Arms International AG, Neuhauen am Rheinfall, Switzerland

[21] Appl. No.: 09/044,993

[22] Filed: Mar. 20, 1998

[30] Foreign Application Priority Data

Mar. 20, 1997 [DE] Germany ..... 197 11 730

[51] Int. Cl.[7] ..... F41C 23/00

[52] U.S. Cl. ..... 42/71.02; 42/74

[58] Field of Search ..... 42/71.01, 71.02, 42/74

[56] References Cited

U.S. PATENT DOCUMENTS

| | | | |
|---|---|---|---|
| 4,199,887 | 4/1980 | Hogue | 42/72.01 |
| 4,221,066 | 9/1980 | Hillberg | 42/71.02 |
| 4,286,401 | 9/1981 | Pachmayr et al. | 42/71.02 |
| 4,570,370 | 2/1986 | Smith et al. | 42/90 |
| 4,833,812 | 5/1989 | Farrar | 42/77.01 |
| 4,936,036 | 6/1990 | Sniezak et al. | 42/71.02 |
| 4,967,503 | 11/1990 | Farrar | 42/72.01 |
| 5,231,237 | 7/1993 | Cupp | 42/71.02 |
| 5,621,997 | 4/1997 | Pearce | 42/71.02 |

FOREIGN PATENT DOCUMENTS

| | | |
|---|---|---|
| 30 00 017 | 11/1980 | Germany . |
| 195 05 829 | 8/1996 | Germany . |

*Primary Examiner*—Charles T. Jordan
*Assistant Examiner*—Jeffrey Howell
*Attorney, Agent, or Firm*—Venable; Gabor J. Kelemen

[57] ABSTRACT

A weapon grip includes a grip body and a cross-sectionally generally U-shaped grip shell, each having opposite side walls and a rear wall interconnecting the side walls. The grip shell which is a one-piece component, is readily removably and replaceably inserted on the grip body in an installed position such that the walls of the grip body face the respective walls of the grip shell. The grip body and the shell body carry respective first and second abutment faces extending parallel to the length dimension of the grip body. The first and second abutment faces are in contact with one another in the installed position. First and second guides are formed on the grip body and the grip shell, respectively, and are disposed relative to one another and relative to the first and second abutment faces such that during motion of insertion of the grip shell on the grip body parallel to the length dimension, the first and second guides are in sliding engagement with one another and, by camming action, shift the grip shell relative to the grip body in a direction transverse to the length dimension for causing the first abutment face to arrive into contact with the second abutment face upon conclusion of the motion of insertion.

11 Claims, 3 Drawing Sheets

REPLACEABLE WEAPON GRIP

CROSS REFERENCE TO RELATED APPLICATION

This application claims the priority of German Application No. 197 11 730.9 filed Mar. 20, 1997, which is incorporated herein by reference.

BACKGROUND OF THE INVENTION

This invention relates to a weapon grip including a grip body and a grip shell having an approximately U-shaped cross section and being releasably and replaceably inserted on the grip body. The grip shell is a one-piece component having a rear wall and two side walls formed thereon.

German Offenlegungsschrift (application published without examination) 195 05 829 describes a handgun grip, to the rear side of which a replaceable back part is secured by inserting a lug into a recess of the grip at the upper end of the rear part and inserting a pin through aligned bores in overlapping webs at the lower end of the rear part. By replacing the back part, the grip may be adapted to the hand configuration of the marksman.

U.S. Pat. No. 4,936,036 discloses a handgun grip which is formed of a grip body and a generally U-shaped grip shell which may be releasably inserted on the grip body. The grip shell has a rear wall and two side walls formed thereon to constitute a one-piece component. The grip shell is inserted from behind and is secured by a transverse pin. Such a mode of securement has the disadvantage that it is not play-free.

German Offenlegungsschrift 30 00 017 describes a grip having a grip member which is approximately U-shaped and may be attached to the grip body from behind and may be secured thereto by screws.

U.S. Pat. No. 4,199,887 describes a handgun grip which includes a grip body and a grip shell. The grip shell which has two side walls and a bottom wall connecting the side walls, is inserted from below onto the grip body and is secured by a screw which passes through the bottom wall and is screwed into a yoke. To ensure that the yoke is aligned for allowing the insertion of the screw, the yoke is guided in arcuate grooves provided in the side walls.

SUMMARY OF THE INVENTION

It is an object of the invention to provide an improved handgun grip which makes possible a great number of individual adaptations to the hand of the marksman and according to which the grip shell is connected without play with the grip body.

This object and others to become apparent as the specification progresses, are accomplished by the invention, according to which, briefly stated, the weapon grip includes a grip body and a cross-sectionally generally U-shaped grip shell, each having opposite side walls and a rear wall interconnecting the side walls. The grip shell which is a one-piece component, is readily removably and replaceably inserted on the grip body in an installed position such that the walls of the grip body face the respective walls of the grip shell. The grip body and the shell body carry respective first and second abutment faces extending parallel to the length dimension of the grip body. The first and second abutment faces are in contact in the installed position. First and second guides are formed on the grip body and the grip shell, respectively, and are disposed relative to one another and relative to the first and second abutment faces such that during motion of insertion of the grip shell on the grip body parallel to the length dimension, the first and second guides are in sliding engagement with one another and, by camming action, shift the grip shell relative to the grip body in a direction transverse to the length dimension for causing the first abutment face to arrive into contact with the second abutment face upon conclusion of the motion of insertion.

DESCRIPTION OF THE PREFERRED EMBODIMENT

Figure 1:
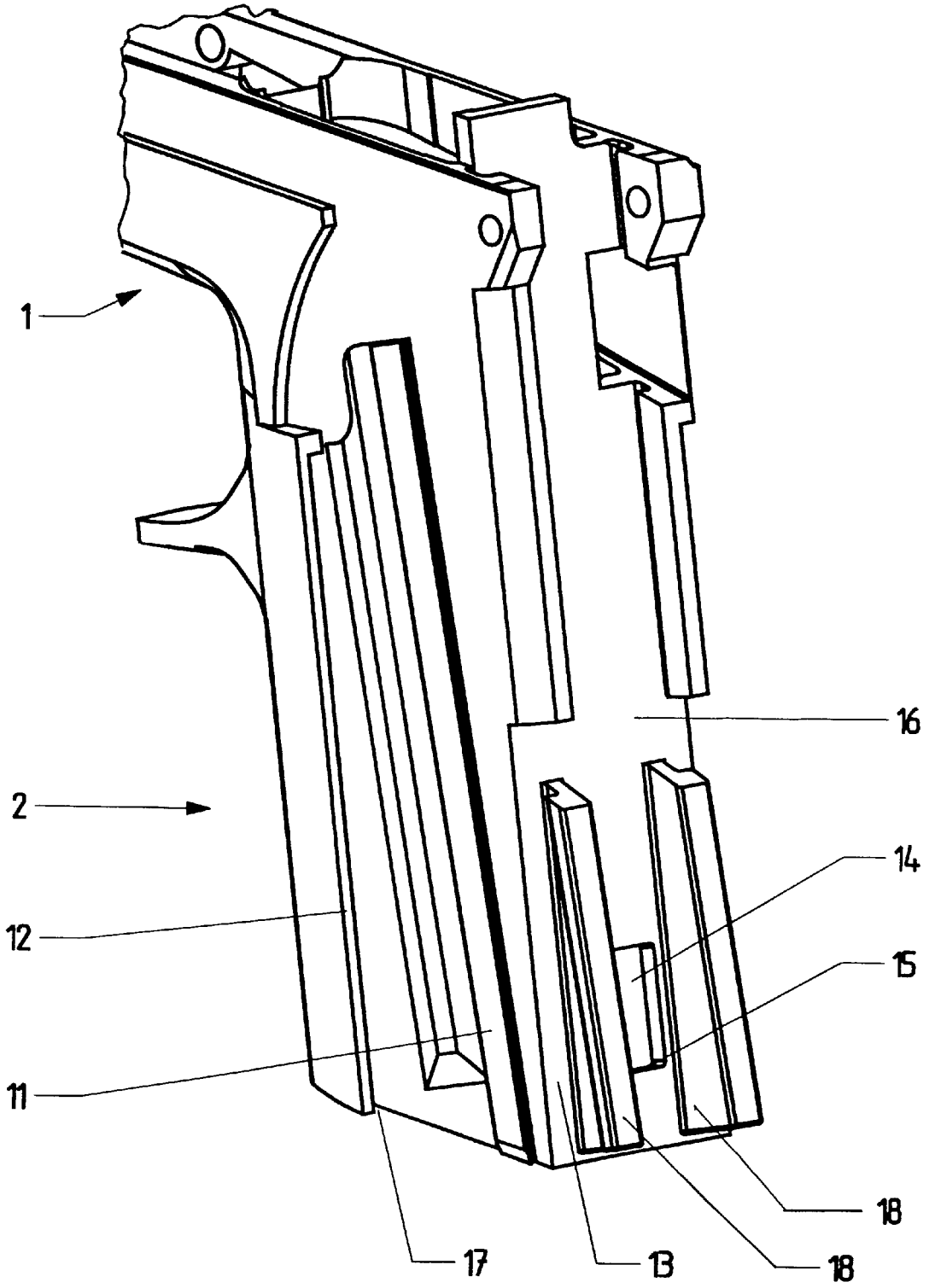
FIG. 1 is a perspective fragmentary view of a handgun, illustrating a grip body according to a preferred embodiment of the invention.
Figure 3:
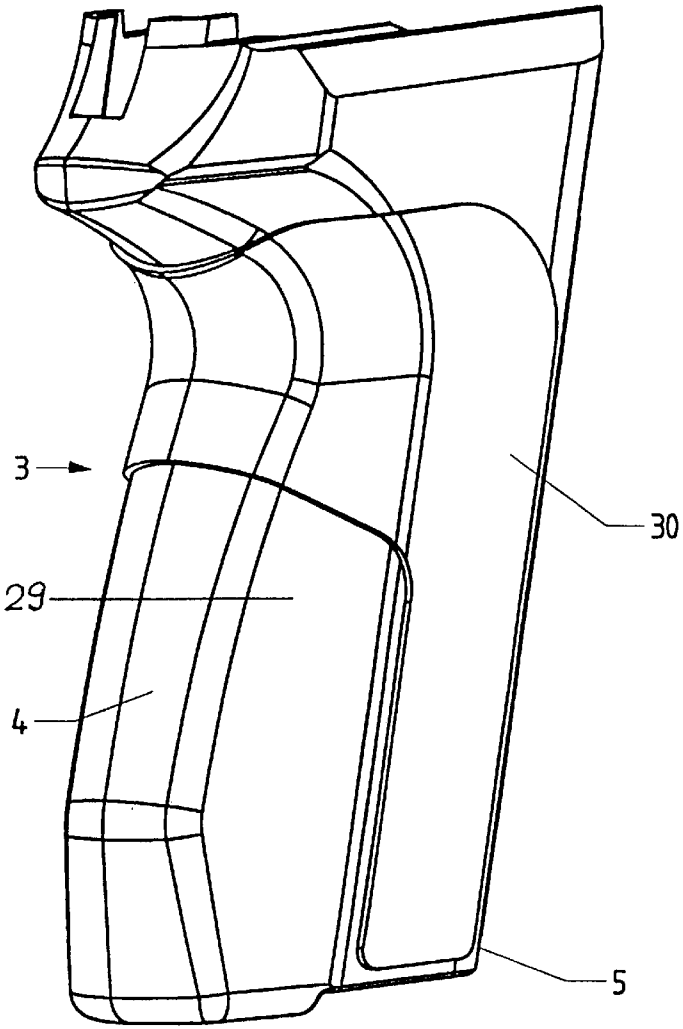
FIGS. 2 and 3 are perspective views of a handgun shell of the preferred embodiment, seen from different directions.
Figure 2:
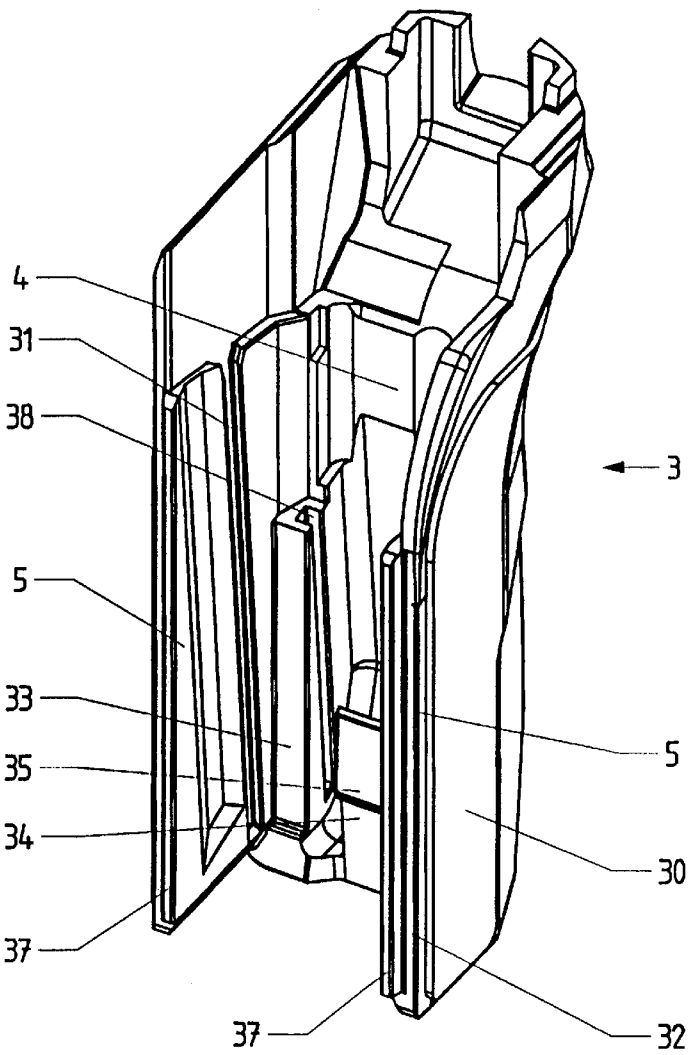

Turning to the Figures, the parts of the handgun shown therein include a lower housing 1 (FIG. 1) having a grip body 2 formed with the housing 1 as a one-piece member as well as a grip shell 3 (FIGS. 2 and 3). Both the grip body 2 and the grip shell 3 are injection molded plastic parts. The grip shell 3 is manufactured preferably in a two-component process in which a base body 29 is of a thermoplastic material whereas a grip element 30 is made of an elastomer. The grip element 30 extends on the exterior of the side walls 5, adjoining the frontal longitudinal edges thereof and across a saddle-shaped region of the upper part of the rear wall 4. The grip element 30 is raised with respect to the base body 29.

The grip shell 3 is U-shaped in cross section. The two side walls 5 are formed on the rear wall 4. Particularly referring to FIGS. 1 and 4, the grip body 2 has on both sides an elevated, cross-sectionally dovetailed strip 11 which is upwardly and forwardly inclined by about 1° to 10° (for example, 3°) relative to the length dimension of the grip body 2. In the assembled state of the weapon grip, a complemental, cross-sectionally dovetailed groove 31 of the grip shell 3 receives the strip 11 of the grip body 2. The grip shell 3 is inserted on the grip body 2 from below, and the upper end of the dovetailed strip 11 enters the lower end of the dovetailed groove 31. The strips 11 and grooves 31 are inclined to respective abutment faces 12, 32 at an angle of between about 1° to 10° (for example, 3°) As the insertion process progresses, the abutment faces 12 and 13 of the grip body 2, and the abutment faces 32 and 33 of the grip shell 3, all extending parallel to the length dimension of 20 the grip body 2, approach one another (because of the camming effect between the strips 11 and the respective grooves 31) until they contact in the final, installed position. As a result, the grip shell 3 is form-fittingly connected with the grip body 2 in a play-free manner.

A resilient tongue 34 having a detent lug 35 extends from the grip shell 3 in the longitudinal direction of the dovetailed grooves 31. In the installed state of the grip shell 3 on the grip body 2, the detent lug 35 snaps behind an edge 15 of an opening 14 provided in the rear wall 16 of the grip body 2. For releasing the grip shell 3 from the grip body 2, the lug 35 may be pressed manually by a finger through the opening 14, from the inside of the empty magazine well of the grip body 2. To prevent an excessive bending of the tongue 34 during such a release operation, behind the tongue 34 an abutment 36 is provided in the grip shell 3.

Figure 4:
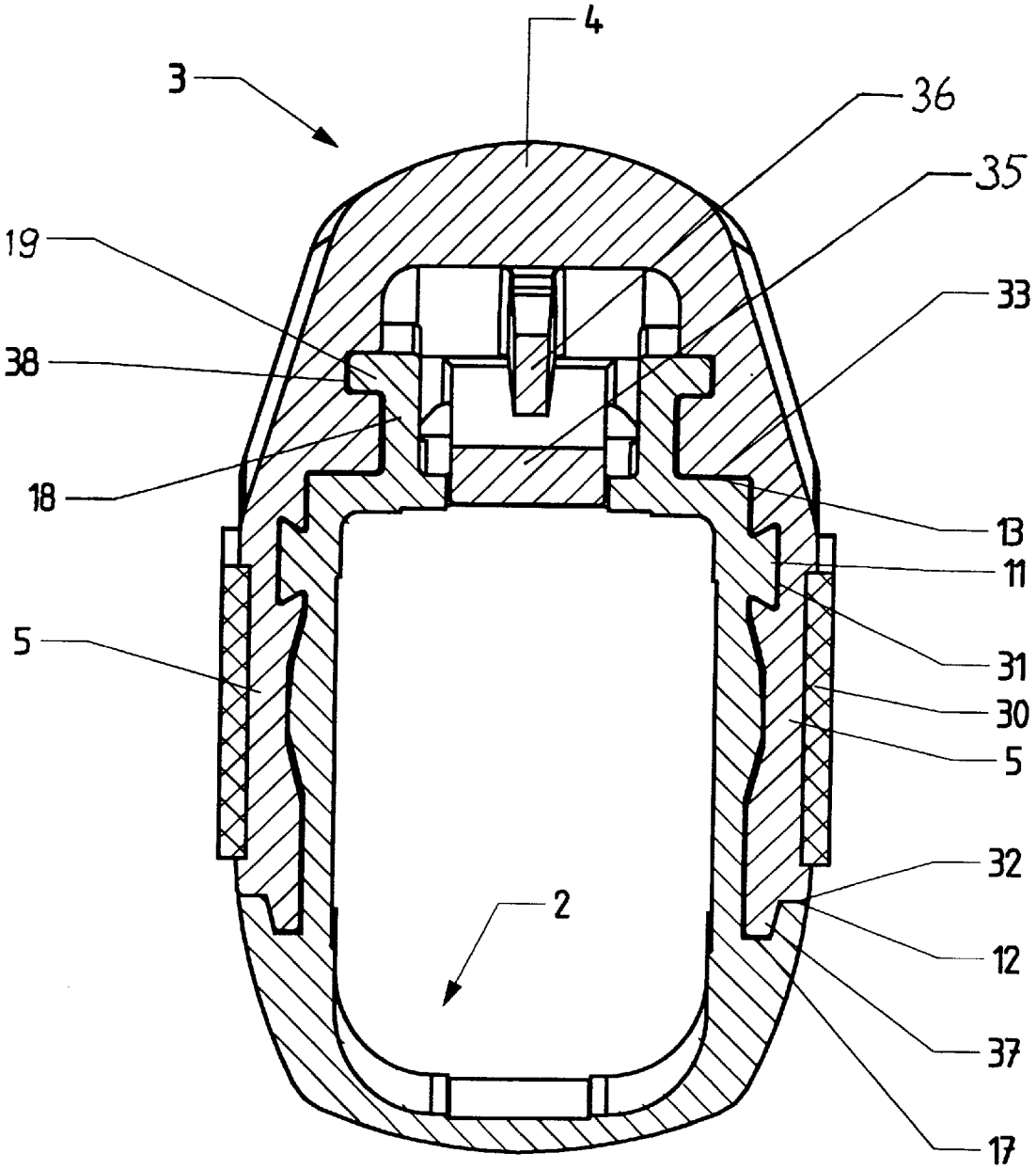
FIG. 4 is a sectional top plan view of the lower part of the assembled handgun grip according to the preferred embodiment.

The frontal longitudinal edge of each lateral wall 5 of the grip shell 3 is provided with a longitudinally extending strip 37 which is narrower than the lateral wall thickness. In the assembled condition each strip 37 engages into a respective, complemental groove 17 of the grip body 2 for improving the form-fitting connection between grip body and grip shell. In the lower zone at the grip body 2 two further strips 18 are provided which extend parallel to the strips 11 and which are cross-sectionally L-shaped and which have respective free outer legs 19 oriented away from one another. With particular reference to FIG. 4, the outer legs 19 are received in respective complemental grooves 38 provided in the grip shell 3. In this manner, a reliable force transmission between the grip body 2 and the grip shell 3 is ensured for taking up shocks during firing.

The described construction results in a secure, rigid and play-free as well as form-locking connection between the grip shell 3 and the grip body 2. Preferably, a set of differently configured grip shells 3 may be made available as a kit. The grip shell structures may differ from one another in width and thickness and/or surface properties and/or material to adapt optimally the handgun grip to the individual requirements of the marksman. In use, the hand of the marksman lies, with the finger pads of the middle finger, ring finger and little finger, the inner face of the thumb, the transition between the thumb and the index finger and the hand pads, on the elastomer gripping element 30 which provides for a damping and adhering gripping effect.

The grip structure according to the invention is adapted not only for handgun grips but also for any weapon having a grip behind the trigger. The grip shell preferably made in a two-component injection process from a thermoplastic base body 29 and the elastomer grip element 30 are also adapted for other types of installment, for example, for mounting from behind. The same applies for the strip-groove connection 37, 17.

It will be understood that the above description of the present invention is susceptible to various modifications, changes and adaptations, and the same are intended to be comprehended within the meaning and range of equivalents of the appended claims.

What is claimed is:

1. In a weapon grip including a grip body having opposite first and second side walls and a first rear wall interconnecting said first and second side walls;

a cross-sectionally generally U-shaped grip shell having opposite third and fourth side walls and a second rear wall interconnecting said third and fourth side walls; said third and fourth side walls and said second rear wall constituting a one-piece component; said grip shell being readily removably and replaceably secured to said grip body in an installed position such that said first and second side walls face said third and fourth side walls and said first rear wall faces said second rear wall;

the improvement comprising.

(a) a first abutment face provided on said grip body and extending parallel to said length dimension;

(b) a second abutment face provided on said grip shell and extending parallel to said length dimension; said first and second abutment faces are in contact in said installed position;

(c) a first guide formed on said grip body; and (d) a second guide formed on said grip shell; said first and second guides being disposed relative to one another and dependent from said first and second abutment faces such that during motion of insertion of said grip shell on said grip body, said first and second guides are in sliding engagement with one an other for shifting said grip shell relative to said grip body in a direction transverse to said length dimension for causing said first abutment face to arrive into said contact with said second abutment face in said installed position upon conclusion of the motion of insertion.

2. The weapon grip as defined in claim 1, wherein said third and fourth side walls have a thickness, a front edge and a strip having a thickness less than the thickness of said third and fourth side walls; each strip extending parallel to said length dimension; and further wherein said first and second side walls have a groove extending parallel to said length dimension; each said strip being introduced into and sliding in a respective said groove during said motion of insertion.

3. The weapon grip as defined in claim 1, wherein said first and second guides are interengageable guide strips and guide grooves oriented at an angle of inclination between about 1° and 10° to said length dimension.

4. The weapon grip as defined in claim 3 wherein said angle of inclination is substantially 3°.

5. The weapon grip as defined in claim 3, wherein said guide strips and grooves have complemental, dovetail-shaped cross sections.

6. The weapon grip as defined in claim 3, further comprising a third guide provided on said grip body at a lower portion thereof adjacent said first rear wall and a fourth guide provided on said grip shell at a lower portion thereof adjacent said second rear wall; said third and fourth guides extending parallel to said first and second guides and being in engagement with one another during said motion of insertion and in said installed position.

7. The weapon grip as defined in claim 1, further comprising detent means for maintaining said grip shell in said installed position; said detent means comprising cooperating, manually releasable snap-in elements provided on said grip body and said grip shell.

8. The weapon grip as defined in claim 7, wherein one of said elements is a bendable tongue and another of said elements is an opening into which said tongue may snap; said detent means further comprising a stop member for limiting an extent of bending of said tongue.

9. The weapon grip as defined in claim 1, wherein said grip shell includes a thermoplastic base body and a co-injected, elastomer grip element.

10. The weapon grip as defined in claim 9, wherein said grip element partially forms said third and fourth side walls;

said grip element having longitudinal edges extending along frontal longitudinal edges of said third and fourth side walls; said grip element further having a portion extending across an upper, saddle-shaped region of said second rear wall; said grip element being raised relative to said base body.

11. a weapon grip including a grip body having opposite first and second side walls and a first rear wall interconnecting said first and second side walls;

a cross-sectionally generally U-shaped grip shell having opposite third and fourth side walls and a second rear wall interconnecting said third and fourth side walls; said third and fourth side walls and said second rear wall constituting a one-piece component; said grip shell being readily removably and replaceably secured to said grip body in an installed position such that said first and second side walls face said third and fourth side walls and said first rear wall faces said second rear wall; the improvement wherein said grip shell includes a thermoplastic base body and a co-injected elastomer grip element; said grip element partially forming said third and fourth side walls; said grip element having longitudinal edges extending along frontal longitudinal edges of said third and fourth side walls; said grip element further having a portion extending across an upper, saddle-shaped region of said second rear wall; said grip element being raised relative to said base body.

* * * * *